US005567572A

United States Patent [19]

Miura et al.

[11] Patent Number: 5,567,572

[45] Date of Patent: Oct. 22, 1996

[54] SUPPORT SHEET FOR PHOTOGRAPHIC PRINTING SHEET

[75] Inventors: Takaharu Miura, Chiba; Masataka Itoh, Yokohama; Chieko Tanaka, Ichikawa, all of Japan

[73] Assignee: New Oji Paper Co., Ltd., Tokyo, Japan

[21] Appl. No.: 312,188

[22] Filed: Sep. 26, 1994

Related U.S. Application Data

[60] Continuation of Ser. No. 30,554, Mar. 12, 1993, abandoned, which is a division of Ser. No. 810,076, Dec. 19, 1991, abandoned.

[30] Foreign Application Priority Data

| | | | |
|---|---|---|---|
| Dec. 21, 1990 | [JP] | Japan | 2-404784 |
| Jan. 7, 1991 | [JP] | Japan | 3-000172 |
| Apr. 19, 1991 | [JP] | Japan | 3-088709 |

[51] Int. Cl.[6] ..... G03C 1/815

[52] U.S. Cl. ..... 430/510; 430/523; 430/532; 430/538; 430/935; 430/942; 428/323; 428/481

[58] Field of Search ..... 430/533, 538, 430/510, 523, 532, 935, 942; 428/323, 481

[56] References Cited

U.S. PATENT DOCUMENTS

| | | | |
|---|---|---|---|
| 4,384,040 | 5/1983 | von Meer | 430/532 |
| 4,396,671 | 8/1983 | Wanka et al. | 428/323 |
| 4,482,628 | 11/1984 | Katsura et al. | 430/538 |
| 4,610,956 | 9/1986 | Fuchizawa et al. | 430/538 |
| 4,645,736 | 2/1987 | Anthonsen et al. | 430/538 |
| 4,665,013 | 5/1987 | Sack et al. | 430/532 |
| 4,729,945 | 3/1988 | Anthonsen et al. | 430/538 |
| 4,731,285 | 3/1988 | Anthonsen et al. | 428/323 |
| 4,844,777 | 7/1989 | Anthonsen et al. | 162/135 |

FOREIGN PATENT DOCUMENTS

| | | |
|---|---|---|
| 57-49946 | 3/1982 | Japan . |
| 59-124336 | 7/1984 | Japan . |
| 60-17104 | 5/1985 | Japan . |
| 60-17105 | 5/1985 | Japan . |
| 60-144736 | 7/1985 | Japan . |
| 62-61049 | 3/1987 | Japan . |
| 62-141543 | 6/1987 | Japan . |
| 1-21495 | 4/1989 | Japan . |
| 2058866 | 4/1981 | United Kingdom . |
| 2078236 | 1/1982 | United Kingdom . |

OTHER PUBLICATIONS

World Patents Index Latest, Section PQ, Week 9030, Derwent Publications Ltd., London, GB; Class P83, AN 90–227079.

*Primary Examiner*—John S. Y. Chu

*Attorney, Agent, or Firm*—Armstrong, Westerman, Hattori, McLeland & Naughton

[57] ABSTRACT

A support sheet for a photographic printing sheet having enhanced anti-fogging and anti-yellowing properties comprises a pulp paper substrate sheet, a front coating layer formed on a front surface of the substrate sheet and comprising a cured resinous material produced from electron beam-curable unsaturated organic compound by an electron beam irradiation thereto and mixed with a white pigment, and a back coating layer formed on a back surface of the substrate sheet and comprising a film-forming synthetic resinous material, in which a magnesium compound is contained, as an anti-fogging agent, in the substrate sheet and/or the front coating layer.

6 Claims, 1 Drawing Sheet

SUPPORT SHEET FOR PHOTOGRAPHIC PRINTING SHEET

This application is a continuation of application Ser. No. 08/030,554 filed Mar. 12, 1993, abandoned, which is a divisional of application Ser. No. 07/810,076 filed Dec. 19, 1991, abandoned.

BACKGROUND OF THE INVENTION

1) Field of the Invention

The present invention relates to a support sheet for a photographic printing sheet. More particularly, the present invention relates to a support sheet for a photographic printing sheet having an enhanced resistance to fogging and yellowing and thus capable of being printed with clear photographic images.

2) Description of the Related Arts

Formerly, a baryta paper sheet was used as a support for a photographic printing sheet. The baryta paper sheet was produced by coating two surfaces of a paper sheet having a good sizing property and mechanical property with a coating material containing a white pigment, for example, barium sulfate.

Recently, a waterproof paper sheet composed of a substrate paper sheet and coating layers formed on two surfaces of the substrate sheet and comprising a polyolefin resin have become widely used as a support sheet for a photographic printing sheet, in place of the baryta sheet.

The photographic printing sheet comprising the waterproof support sheet is advantageous in that, in a developing step for the photographic printing sheet, the highly hydrophobic polyolefin coating layer obstructs a penetration of a developing solution into the support sheet, and accordingly, the time needed for washing and drying the printing sheet can be shortened, and the shrinkage and elongation of the support sheet be restricted, and thus the photographic printing sheet exhibits a superior dimensional stability.

Nevertheless, the polyolefin resin-coated support sheet is disadvantageous in the following item.

The polyolefin resin coating layer contains an inorganic white pigment, for example, titanium dioxide, for enhancing an opacifying power and a resolving power of the resultant photographic printing sheet, but this pigment has a poor dispersion in the polyolefin resin. Also, the pigment contains a volatile substance, and in a melt-extruding step of the polyolefin resin, the volatile substance forms bubbles in the polyolefin resin melt, and thus the resultant polyolefin resin coating layer is sometimes cracked.

To avoid the above-mentioned disadvantages, the amount of the white pigment to be added to the polyolefin resin cannot be increased to a high level sufficient to obtain a satisfactory opacifying and resolving power of the resultant photographic printing sheet. Generally speaking, when the white pigment consists of titanium dioxide, it is difficult to add the titanium dioxide pigment in an amount of about 20% by weight or more to the polyolefin resin. Accordingly, the photographic printing sheet prepared from the conventional polyolefin resin-coated support sheet does not have a satisfactory sharpness of the images printed thereon.

Recently, a support sheet for a photographic printing sheet having an electron beam-cured resin coating layer formed by coating a surface of a substrate paper sheet with an electron beam-curable resin composition comprising an organic unsaturated compound curable by an electron beam irradiation, and irradiating an electron beam to the coated layer of the resin composition, was disclosed in, for example, Japanese Examined Patent Publication Nos. 60-17,104 and 60-17,105 and Japanese Unexamined Patent Publication No. 57-49,946.

In this type of support sheet, the resin composition to be coated on a surface of a substrate paper sheet need not be heated at a high temperature, and thus can contain the inorganic white pigment in a large amount of 20 to 80% by weight. Therefore, the resultant photographic printing sheet produced from this type of support sheet can record thereon photographic images with a significantly enhanced sharpness, in comparison with those of the conventional polyolefin resin-coated photographic printing sheet.

Nevertheless, this type of photographic printing sheet, in which a photo-sensitive Layer is formed on an electron beam-cured resin coating layer, is disadvantageous in that, when developed with a developing solution of photographic chemicals, a portion of the developing chemicals is adsorbed by and remains on the electron beam-cured resin coating layer, and causes the printing sheet to turn yellow after the development. Also, when developed after storage for a long time, non-neglectable fogging occurs in the developed photographic printing sheet, or the photo-sensitivity of the photographic printing sheet is changed.

Various attempts have been made to eliminate the above-mentioned disadvantages. For example, Japanese Examined Patent Publication No. 1-21,495 discloses an attempt to form a polyethylene coating layer on an electron beam-cured resin coating layer, to thereby restrict the change in the photo-sensitivity during a storage of the photographic printing sheet. This attempt is disadvantageous, however, in that, to obtain a satisfactory prevention of the change in the photo-sensitivity, the polyolefin coating layer must be formed in a large thickness, and this causes the sharpness of the resultant photographic images to become unsatisfactory, even though the electron beam-cured resin coating layer is employed to increase the sharpness of the printed images.

Japanese Unexamined Patent Publication No. 60-144,736 discloses an attempt to arrange a barrier layer between a substrate paper sheet and an electron beam-cured resin coating layer, to thus restrict any change in the photographic sensitivity of the photographic printing sheet. The barrier layer made from the materials disclosed in the Japanese Publication, however, is not satisfactory when trying to prevent the occurrence of fogging after storage for a long time.

Also, Japanese Unexamined Patent Publication Nos. 62-61,049 and 61-141,543 disclose a specific polymer or monomer for forming the barrier layer, but this specific polymer or monomer does not satisfactorily remove the above-mentioned disadvantages.

Further, Japanese Unexamined Patent Publication No. 59-124,336 discloses a barrier layer arranged between a substrate paper sheet and an electron beam-cured resin coating layer and prepared from at least one member selected from aqueous solutions of water-soluble polymeric material and dispersions of polyolefin homopolymers and copolymers and polyacrylate and polymethacrylate homopolymers and copolymer, to restrict the change in photographic sensitivity.

The barrier layer made from the polymeric material disclosed in the Japanese Publication does not provide a satisfactory prevention of fogging of the resultant phonographic printing sheet after a storage thereof for a long time.

Generally, it is known that the relationship between the energy level of the electron beam applied to an electron beam-curable compound composition and the fog density of the resultant photographic printing sheet due to a developing solution is contrary to the relationship between the energy level of the electron beam and the yellowing density. Namely, when the electron beam is applied in a large energy level, the yellowing caused by the developing solution is restricted to a low level but the fogging is promoted to a high intensity. Also, when the electron beam is applied in a low energy level, the yellowing density is significantly increased, whereas the fog density is decreased, and the physical properties, for example, adhesive strength and mechanical strength, of the resultant cured resin coating layer are poor.

Accordingly, to prevent or restrict the yellowing and fogging of the photographic printing sheet without affecting the physical properties of the cured resin coating layer, it is necessary to control the energy level of the electron beam to an optimum level. Also, to eliminate all of the above-mentioned disadvantages, it is very important to provide a new type of support sheet capable of preventing the yellowing and fogging of the resultant photographic printing sheet without depending on the quantity of the electron beam applied in the formation of the cured resin coating layer.

SUMMARY OF THE INVENTION

An object of the present invention is to provide a support sheet for a photographic printing sheet having a high surface smoothness, a satisfactory water resistance and an excellent resistance to yellowing and fogging even after a storage for a long time.

The above-mentioned object can be attained by the support sheet for a photographic printing sheet of the present invention, which comprises, a substrate sheet comprising a base paper sheet containing, as a principal component, a cellulosic pulp material;

- a front coating layer formed on a front surface of the substrate sheet and comprising as a principal component, a mixture of a cured resinous material produced from at least one electron beam-curable unsaturated organic compound by irradiating an electron beam thereto, with a white pigment; and
- a back coating layer formed on a back surface of the substrate sheet and comprising, as a principal component, a film-forming synthetic resinous material, at least one member of the substrate sheet and the front coating layer containing an anti-fogging agent comprising at least one magnesium compound, in an amount of 1 $g/m^2$ or more.

In an embodiment of the present invention, the anti-fogging agent comprising at least one magnesium compound is contained in the base paper sheet of the substrate sheet in an amount of 0.1 to 70%, based on the total weight oil the substrate sheet.

In another embodiment of the present invention, the substrate sheet has at least one pigment layer coated on at least one surface of the base paper sheet, and the anti-fogging agent comprising at least one magnesium compound is present in an amount of 1 to 50 $g/m^2$ in the pigment layer.

In a further embodiment of the present invention, the anti-fogging and yellowing agent comprising at least one magnesium compound is contained in the front coating layer, and is present in an amount of 20 to 80% based on the total dry weight of the front coating layer.

DESCRIPTION OF THE PREFERRED EMBODIMENTS

Generally, it is known that, when a photographic printing sheet is produced by coating a photographic emulsion layer on a support sheet comprising a substrate sheet comprising a cellulosic pulp paper sheet and a resin coating layer formed by coating an electron beam-curable unsaturated organic compound composition on a surface of the substrate sheet and applying an electron beam irradiation thereto, a significant fogging occurs in the resultant photographic printing sheet during a storage thereof.

Although the mechanism of the fogging phenomenon is not completely clear, it is assumed that active radicals are generated in the photographic printing sheet due to the electron beam irradiation, and the active radicals react with the photographic emulsion layer to create the fogging phenomenon.

Also, it is assumed that the active radicals are generated mainly from cellulose in the substrate sheet and the electron beam-cured resin, and the fogging phenomenon are mainly influenced by the the active radicals generated from the cellulose.

The inventors of the present invention discovered for the first time that the fogging phenomenon can be prevented or restricted by adding at least one magnesium compound in an amount of 1 $g/m^2$ or more, in at least one of the substrate sheet and the front coating layer.

The mechanism of preventing or restricting the fogging phenomenon by utilizing the magnesium compound has not been made completely clear, but it is assumed that the penetration of the active radicals generated from the cellulose in the substrate sheet by the electron beam irradiation into the photographic emulsion layer is prevented or hindered by some actions of the magnesium compound, and thus the anti-fogging property of the photographic printing sheet is improved.

Accordingly, in the formation of the cured resin coating layer on the base paper sheet-containing substrate sheet, even when the electron beam is at an energy level high enough to prevent the yellowing of the photographic printing sheet, the fogging of the photographic printing sheet can be satisfactorily restricted.

Figure 1:
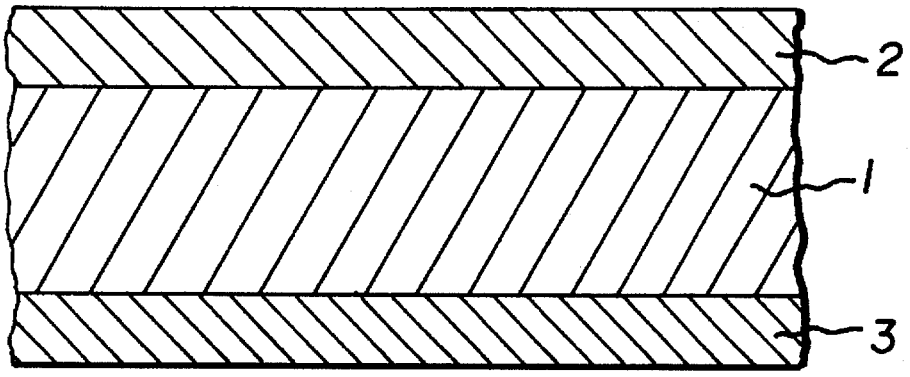
FIG. 1 shows an explanatory cross-sectional profile of an embodiment of the support sheet of the present invention; and, FIG. 2 shows an explanatory cross-sectional profile of another embodiment of the support sheet of the present invention.

Referring to FIG. 1, a support sheet for a photographic printing sheet is composed of a substrate sheet 1 consisting of a paper sheet, a front coating layer 2 formed on a front surface of the substrate sheet 1, and a back coating layer 3 formed on a back surface of the substrate sheet.

The anti-fogging and yellowing agent comprising at least one magnesium compound is contained in the substrate paper sheet 1 and/or the front coating layer 2.

Figure 2:
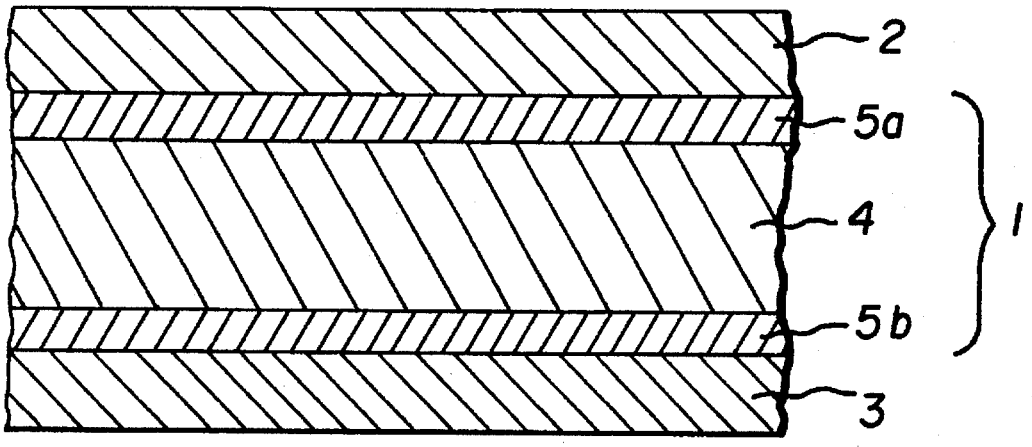

Referring to FIG. 2, the substrate sheet 1 is composed of a base paper sheet 4 and a front pigment layer **5*a* formed on a front surface of the base paper sheet 4, and a back pigment layer 5*b* formed on a back surface of the base paper sheet 4**.

The substrate sheet may have a single pigment layer formed on a front or back surface of the base paper sheet 4.

In the support sheet shown in FIG. 2, the anti-fogging agent comprising at least one magnesium compound is contained in the pigment layer or layers.

The magnesium compound usable for the anti-fogging and yellowing agent is preferably selected from the group consisting of magnesium hydroxide, magnesium carbonate, magnesium oxide and magnesium sulfate, which are substantially insoluble in water at room temperature. More preferably, the magnesium compound is selected from magnesium hydroxide and magnesium oxide. Preferably, the magnesium compound is in the form of fine solid particles having an average size of 0.1 to 100 μm.

Optionally, the magnesium compound is used in the state of a mixture with an additional white pigment, for example, finely divided calcium carbonate, titanium dioxide, talc, clay, barium sulfate and aluminum oxide. There is no limitation of the amount of the additional pigment to be mixed to the magnesium compound, and the additional pigment is employed preferably in an amount of 40% or less based on the total weight of the magnesium compound and the additional pigment. If the amount of the additional pigment is more than 40%, sometimes the anti-fogging effect of the magnesium compound becomes unsatisfactory.

As shown in FIG. 1, the substrate sheet of the support sheet of the present invention is composed of base paper sheet alone.

Alternatively, the substrate sheet is composed of base paper sheet and at least one pigment layer coated on at least one surface of the base paper sheet, as shown in FIG. 2.

The base paper sheet for the substrate sheet is usually selected from paper sheets made from softwood pulp, hardwood pulp, and a mixture of the softwood and hardwood pulps. Also, the wood pulps are not limited specific types of pulps made by specific pulping methods, but preferably are selected from the kraft pulps, sulfite pulps and soda pulps usually used for making paper sheets. If necessary, the wood pulps are blended with a synthetic pulp or synthetic fibers, to make the paper sheets.

There is no restriction on the type, basis weight and thickness of the base paper sheet, but preferably the base paper sheet has a high surface smoothness enhanced by applying a compressive force thereto by a calender or the like, and has a basis weight of from 50 to 300 g/m$^2$ aid a thickness of 40 to 270 μm.

The base paper sheet usable for the present invention optionally contains at least one paper additive, for example, dry paper strength reinforcers, for example, cationic starches, cationic polyacrylamides, and anionic polyacrylamides, sizing agents, for example, fatty acid salts, rosin, maleic acid-modified rosin, cationic sizing agents, and reactive sizing agents, fillers, for example, clay, talc, and kaolin, wet paper strength reinforcers, for example, melamine-formaldehyde resins and epoxidized polyamide resins, fixing agents, for example, aluminum sulfate and cationic starches, and pH-adjusting agents, for example, caustic soda and sodium carbonate. The paper sheet can be tub-sized or size-pressed by a treating liquid containing at least one member selected from water-soluble polymeric additives, sizing agents, inorganic electrolytes, hygroscopic substances, pigments and pH-adjusting agents.

In the production of the paper sheet containing the magnesium compound, at least one magnesium compound is mixed into a pulp slurry, and the mixed pulp slurry is converted a paper sheet. Alternatively, the magnesium compound is incorporated into a paper sheet by a press-sizing method in which the paper sheet is coated or impregnated with a dispersion containing the magnesium compound. In the base paper sheet, the anti-fogging magnesium compound is preferably present in an amount of 0.1 to 70%, more preferably 1 to 40%, based on the total weight of the substrate sheet. If the amount of the magnesium compound is less than 0.1% by weight, the resultant photographic printing sheet sometimes exhibits an unsatisfactory anti-fogging effect. Note, the use of the magnesium compound in an excessively large amount more than 70% by weight is not effective for successively enhancing the anti-fogging effect, and sometimes results in a lowering of the paper strength, an undesirable powdering, and in a deterioration of the photographic performance of the photographic printing sheet.

In an embodiment of the support sheet of the present invention, the anti-fogging magnesium compound is contained in at least one pigment layer formed on at least one surface of the base paper sheet.

The pigment layer can be formed by coating the surface of the base paper sheet with a coating liquid containing the anti-fogging magnesium compound, a binder, and optionally, an additional white pigment, and drying the resultant coating liquid layer.

The binder can be selected from conventional polymeric materials usable for coating a paper sheet, for example, SBR latexes, polyvinyl alcohols, gelatine and starch.

The mixing ratio of the anti-fogging magnesium compound to the binder is not limited to a specific level, as long as the magnesium compound particles can be evenly mixed in the binder. Generally, the higher the mixing ratio of the magnesium compound to the binder, the higher the anti-fogging effect of the resultant photographic printing sheet.

The coating liquid for the pigment layer can be prepared by a conventional dispersing apparatus, for example, a three roll mill, two roll mill, Cowless dissolver, homomixer, sand grinder, Dyno mill, and ultrasonic dispersing machine.

The coating operation of the coating liquid on the base paper sheet can be carried out by a conventional coating method, for example, bar coating method, air doctor coating method, blade coating method, squeeze-coating method, air-knife coating method, reverse roll coating method or transfer-coating method. Further, a fountain coating method or a slit die coating method can be applied to the coating operation.

The resultant coating liquid layer on the base paper sheet can be dried by a conventional drying method.

To obtain a pigment layer having a high surface smoothness, a cast coating method in which a cast drum is used is advantageously employed.

Preferably, the pigment layer is formed in a weight of 1 to 50 g/m$^2$, more preferably 5 to 25 g/m$^2$, on the base paper sheet. If the amount of the pigment layer is less than 1 g/m$^2$, the resultant photographic printing sheet sometimes exhibits an unsatisfactory anti-fogging effect. Also, the use of the pigment layer having a large weight of more than 50 g/m$^2$ does not contribute to an enhancing of the anti-fogging effect of the resultant photographic printing sheet, the coating liquid is wastefully consumed, and the resultant photographic printing sheet exhibits a lowered resistance to curling.

The pigment layer optionally contains an additive, for example, a surfactant, film-hardening agent, matting agent, antistatic agent and anti-fogging agent other than the magnesium compound.

The surfactants unable for the pigment layer include natural surfactants, for example, saponin and synthetic surfactants including anion surfactants, for example, alkali salts of higher fatty acids, alkyl sulfates, alkyl sulfonates, and sulfosuccinic acid esters, cation surfactants, for example, higher amine halogeno-acid salts, alkylpyridium halides, and quarternary ammonium salts, non-ionic surfactants, for example, polyethyleneglycol alkylethers and polyethyleneglycol fatty acid esters and amphoteric ion surfactants, for example, aminoacid derivatives.

In the support sheet of the present invention, a front coating layer is formed on a front surface of the substrate sheet. This front coating layer comprises, as a principal component, a mixture of a cured resinous material with a white pigment. The cured resinous material is produced from at least one unsaturated organic compound capable of being cured by irradiating an electron beam thereto.

The electron beam-curable unsaturated organic compound usable for the present invention is preferably selected from the group consisting of:

(1) acrylate compound (or acrylic acid esters) of mono-to hexahydric aliphatic, cycloaliphatic and aromatic alcohols and polyalkyleneglycols;

(2) acrylate compounds (or acrylic acid esters) of addition products of mono-to hexahydric aliphatic, cycloaliphatic and aromatic alcohols with alkyleneoxides;

(3) polyacryloylalkylphosphoric acid esters;

(4) reaction products of carboxylic acids with polyols and acrylic acid;

(5) reaction product of isocyanates with polyols and acrylic acids;

(6) reaction products of epoxy compounds with acrylic acid; and (7) reaction products of epoxy compounds with polyols and acrylic acid.

The electron beam-curable unsaturated organic compounds include, for example, polyoxyethylene-epichlorohydrin-modified bisphenol A diacrylate, dicyclohexylacrylate, epichlorohydrin-modified polyethyleneglycol diacrylate, 1,6-hexanediol diacrylate, hydroxyvibaripivalic acid esterneopentylglycol diacrylate, nonylphenoxy-polyethyleueglycol acrylate, ethyleneoxide-modified phenoxidzed phosphoric acid acrylate, ethyleneoxide-modified phthalic acid acrylate, polybutadieneacrylate, coprolactam-modified tetrahydrofurfuryl acrylate, tris(acryloxyethyl) isocyanurate, trimethylolpropane triacrylate, pentaerythritol triacrylate, dipentaerythritol hexaacrylate, polyethyleneglycol diacrylate, 1,4-butadienediol diacrylate, neopentylglycol diacrylate, and neopentyl-glycol-modified trimethylolpropanediacrylate.

The white pigment in the front coating layer preferably comprises at least one member selected from the group consisting of titanium dioxide which may be an anatase type or rutile type, barium sulfate, calcium carbonate, zinc oxide and aluminum oxide.

To enhance a dispersing property of the white pigment particles, for example, titanium dioxide particles, the surfaces of the pigment particles are coated with metal oxide, for example, aluminum oxide.

The white pigment is preferably present in an amount of 20 to 80%, based on the total amount of the front coating layer.

If the content of the white pigment is less than 20% by weight, the resultant front coating layer exhibits an unsatisfactory opacifying power, and thus the photographic images recorded on the resultant photographic printing sheet have an unsatisfactory sharpness and clarity. If the content of the white pigment is more than 80% by weight, the resultant front coating layer exhibits an unsatisfactory flexibility, and thus is sometimes cracked.

In an embodiment of the support sheet of the present invention, a portion or all of the white pigment in the front coating layer consists of at least one anti-fogging magnesium compound.

In this embodiment, the content of the anti-fogging magnesium compound is preferably 80% or less based on the total amount of the front coating layer. Also, the amount of the anti-fogging and yellowing magnesium compound in the front coating layer is preferably 1 $g/m^2$ or more.

The front coating layer can be formed by coating a front surface of a substrate sheet with a coating liquid containing the electron beam-curable unsaturated organic compound and the white pigment, and irradiating an electron beam to the resultant coating liquid layer, to cure and solidify the same.

The preparation of the coating liquid can be carried out in the same manner as that fur the above-mentioned coating liquid for the pigment layer.

Also, the coating of the coating liquid on the substrate sheet can be carried out in the same manner as that for the pigment layer-coating liquid.

To obtain a front coating layer having a high surface smoothness and gloss, the coating operation is preferably carried out by a coating method in which a casting drum is employed.

The irradiation of the electron beam is carried out to cure and solidify the coated coating liquid layer on the substrate sheet. For this electron beam irradiation, preferably a curtain type electron beam accelerator, which is relatively cheap and can generate a large output, is utilized. In this accelerator, the accelerating voltage for electron beam is usually from 100 to 300 kV and the energy level is from 0.1 to 6 Mrad, more preferably 0.2 to 4 Mrad.

If the energy level is less than 0.1 Mrad, the reaction of the unsaturated bonds in the unsaturated organic compound in the coated coating liquid layer sometimes cannot be completed, and thus a non-reacted unsaturated organic compound remains in the cured resinous layer and sometimes affects the photographic property of the resultant photographic printing sheet.

Generally, when the energy level is small, the degree of cross-linkage of the cured resin becomes low, and thus the anti-yellowing property of the resultant photographic printing sheet is affected by the low cross-linkage of the cured resin.

When the support sheet of the present invention is employed, the resultant photographic printing sheet exhibits a high anti-fogging property even if the election beam curing is carried out at a high energy level. Also, when the electron beam irradiation is carried out at a high energy level, the resultant photographic printing sheet exhibits an enhanced anti-yellowing property.

Nevertheless, the energy level of the electron beam must be controlled to an appropriate level, because an excessively high energy level results in a wasteful consumption of energy, and sometimes causes the resultant front coating layer to exhibit an undesirably high hardness and rigidity, and thus the resultant photographic printing sheet is curled.

The electron beam irradiation is preferably carried out in a non-oxidative atmosphere containing oxygen in a restricted concentration of 500 ppm or less. If the oxygen concentration is more than 500 ppm, the oxygen serves as a retarding agent for a polymerization of the unsaturated organic compound, and thus the curing reaction of the unsaturated organic compound becomes poor.

When the electron beam curing is carried out by a drum curing method, in which a coating liquid layer formed on a substrate sheet is brought into contact with the peripheral surface of a curing drum and an electron beam is irradiated to the coating liquid layer through the substrate sheet, the coating liquid layer is not directly exposed to the ambient air atmosphere, and thus this electron beam irradiation can be effected without lowering the oxygen concentration of the atmosphere. Nevertheless, this drum curing operation using the electron beam irradiation may be carried out in an inert gas atmosphere, to prevent or hinder a generation of ozone due to the electron beam irradiation through the atmosphere, or to cool a window through which the electron beam is irradiated and which is exothermically heated by the electron beam irradiation.

The front coating layer preferably has a weight of 2 to 60 $g/m^2$ more preferably 10 to 30 $g/m^2$.

In the support sheet of the present invention, a back coating layer is formed on a back surface of the substrate sheet. This back coating layer comprises a film forming synthetic resin which can be selected from conventional synthetic resins usable for coating the substrate sheet for photographic printing sheet.

The synthetic resins include polyolefin resins and the same electron beam-cured resins as mentioned above.

The polyolefin resins include homopolymers of ethylene and α-olefins, for example, propylene, copolymers of at least two of ethylene and α-olefins, and mixtures of at least two of the above-mentioned homopolymers and copolymers.

Preferable polyolefin resins for the present invention are low density polyethylene resins, high density polyethylene resins, linear chain type low density polyethylene resins, and mixtures of at least two of the above-mentioned resins.

There is no specific limitation of the molecular weight of the polyolefin resins, but preferably the molecular weight of the polyolefin resins is from 20,000 to 200,000.

The back coating layer comprising the polyolefin resin can be formed on the back surface of the substrate sheet by a customary melt extrusion-coating method.

The back coating layer comprising the electron beam-cured resinous material can be formed by the same method as that used for the front coating layer, as mentioned above.

The back coating layer optionally contains at least one additive for example, an anti-oxidant or surfactant.

Preferably, the back coating layer has a weight 10 to 40 $g/m^2$.

EXAMPLES

The present invention will be further explained the following specific examples, which are only representative and in no way restrict the scope of the present invention.

Example 1

A mixed pulp slurry with a consistency of 1.0% was prepared from a mixture of 20% by weight of a bleached softwood sulfate pulp (NBSP) beaten to a Canadian standard freeness of 250 ml and 80% by weight of a bleached hardwood kraft pulp (LBKP) beaten to a Canadian standard freeness of 280 ml determined in accordance with Japanese Industrial Standard P 8121-76.

To the mixed pulp slurry was added an additive having the following composition:

| Component | Amount by weight (*)[1] |
|---|---|
| Cationic starch derivative | 2.0% |
| Alkylketone dimer resin | 0.4% |
| Anionic polyacrylic amide resin | 0.1% |
| Polyamidepolyamineepichloro-hydrin resin | 0.7% |

Note:
(*) . . . The amount in % is based on the weight of the mixed pulp.

The composition was mixed with an aqueous sodium hydroxide solution, to adjust the pH of the composition to a level of 7.5.

The mixed pulp was uniformly suspended in water, and then to the resultant pulp slurry was added finely divided magnesium hydroxide in an amount such that after the resultant pulp slurry was converted to a paper sheet the content of magnesium hydroxide being 5% based on the dry weight of the resultant paper sheet, while agitating the mixture for 5 minutes.

The consistency of the solid content of the mixed pulp slurry was adjusted to 0.05% and then the adjusted slurry was further agitated for 5 minutes.

A paper sheet having a basis weight of 180 $g/m^2$ and a density of 1.0 $g/m^3$ was produced from the resultant mixed pulp slurry, by using a hand paper-making machine available from Toyo Seiki K.K.

The resultant paper sheet was employed as a substrate sheet.

A back surface of the substrate sheet was coated with a polyethylene resin by a customary melt extrusion-coating method.

The resultant back coating layer had a weight of 30 $g/m^2$.

Separately, an electron beam-curable resinous composition was prepared in the following composition:

| Component | Part by weight |
|---|---|
| Epoxy acrylate oligomer $(*)_2$ | 70 |
| Di-functional acrylate monomer $(*)_3$ | 30 |
| Titanium dioxide $(*)_4$ | 25.0 |

Note:
$(*)_2$ . . . Available under the trademark of Viscoat 540, from Osaka Yukikayaku K.K.
$(*)_3$ . . . Available under the trademark of HDDA, from Nihon Kayaku K.K.
$(*)_4$ . . . Available under the trademark of A220, from Ishihara Sangyo K.K.

The composition was mixed and dispersed in a paint conditioner for one hour.

A front surface of the substrate sheet was coated with the electron beam curable resinous composition in an amount of 25 $g/m^2$ by using a wire coating bar. Then an electron beam was applied to the composition layer under an accelerating voltage of 165 kV at an energy level of 3 Mrad, to cure the composition layer.

A specimen of the resultant support sheet was subjected to a measurement of an anti-fogging effect thereof, in the following manner.

The specimen of the support sheet was superimposed on a specimen of a conventional photographic printing sheet so that the front coating layer of the support sheet specimen came into contact with a photographic emulsion layer surface of the photographic sheet specimen, and the resultant test piece was left to stand in a dark room at a temperature of 70° C. at a relative humidity of 50% for 3 days. Then the support sheet specimen was separated from the photographic sheet specimen, and the photographic sheet specimen was subjected to a customary development by using an automatic developing machine available under the trademark of RCP20, from Dast Co.

The fog density of the developed specimen was measured in a customary manner by using a Macbeth densitometer available under the trademark of Model No. RD-914, from Kollmorgen Corp.

The test results are shown in Table 1.

Example 2

The same experimental procedures as in Example 1 were carried out except that the final content of magnesium hydroxide in the paper sheet after the paper-making step was adjusted to 60%, based on the total dry weight of the paper sheet.

The test results are shown in Table 1.

Comparative Example 1

The same experimental procedures as in Example 1 were carried out except that no magnesium hydroxide was added to the paper sheet.

The test results are shown in Table 1.

Referential Example 1

A resin-coated paper sheet was produced by coating two surfaces of a paper sheet not containing magnesium compound with a polyethylene in an amount of 25 g/m$^2$.

The same test as mentioned in Example was applied to the resin-coated paper sheet.

The test results are shown in Table 1.

TABLE 1

| Example No. | Item | Magnesium compound contained in substrate paper sheet: Type | Amount (% by wt) | Energy level of electron beam (Mrad) | Fog density |
|---|---|---|---|---|---|
| Example | 1 | $Mg(OH)_2$ | 5 (9 g/m$^2$) | 3 | 0.12 |
| Example | 2 | $Mg(OH)_2$ | 60 (108 9/m$^2$) | 3 | 0.11 |
| Comparative Example | 1 | None | — | 3 | 2.03 |
| Referential Example | 1 | RC paper sheet | | — | 0.14 |

Example 3

A paper sheet having a base weight of 175 g/m$^2$ and free from a magnesium compound was employed as a base paper sheet for a substrate sheet.

A coating liquid for a pigment layer was prepared from the following composition.

| Component | Part by solid weight |
|---|---|
| Magnesium hydroxide | 80.0 |
| SBR latex $(*)_5$ | 20.0 |

Note:
$(*)_5$ . . . Available under the trademark of JSR 2287, from Nihon Goseigomu K.K.

In the preparation of the coating liquid, a magnesium hydroxide powder was mixed into water and then dispersed by using a Cowless dissolver for one hour, and the resultant dispersion then mixed with the SBR latex.

The coating liquid was coated on a front surface of the base paper sheet by using a bar coater, and the resultant coating liquid layer was dried at a temperature of 120° C.

A substrate sheet having a pigment layer with a dry weight of 5 g/m$^2$ was obtained.

A back surface of the base paper sheet was coated with a polyethylene resin by a customary melt extrusion-coating method, to form a back coating layer having a weight of 30 g/m$^2$.

A front coating layer was formed on the pigment layer of the substrate sheet in the same manner as mentioned in Example 1, to provide a support sheet.

A specimen of the support sheet was subjected to the same fog density test as in Example 1.

The test results are shown in Table 2.

Example 4

The same procedures as in Example 3 were carried out, except that the dry weight of the pigment layer was 20 g/m$^2$.

The test results are shown in Table 2.

Example 5

The same procedures as in Example 3 were carried out except that the pigment layer containing magnesium hydroxide was formed on a back surface of the base paper sheet, the back coating layer was formed on the pigment layer, and the dry weight of the pigment layer was changed to 20 g/m$^2$.

The test results are shown in Table 2.

Example 6

The same procedures as in Example 3 were carried out except that the back surface of the base paper sheet was coated with the same pigment layer as that formed on the front surface of the base paper sheet.

The test results are shown in Table 2.

Comparative Example 2

The same procedures as in Example 3 were carried out except that no pigment layer was formed on the base paper sheet and the front coating layer was coated directly on the front surface of the base paper sheet.

The test results are shown in Table 2.

Comparative Example 3

The same procedures as in Example 3 were carried out except that the weight of the pigment layer was reduced to 0.5 g/m$^2$, and thus the amount of the magnesium compound was decreased to 0.4 g/m$^2$.

The test results are shown in Table 2.

Comparative Example 4

The same procedures as in Example 3 were carried out except that no magnesium hydroxide was employed, thus the front surface of the base paper sheet was coated with the SBR latex in a dry weight of 5 g/m$^2$.

The test results are shown in Table 2.

Comparative Example 5

The same procedures as in Example 3 were carried out except that the magnesium hydroxide was replaced precipitated calcium carbonate available under the trademark of Brilliant-15, from Shiraishi Kogyo K. K.

The test results are shown in Table 2.

Referential Example 2

A customary resin-coated paper sheet for a photographic printing sheet, having front and back coating layers comprising a polyethylene resin and directly coated on a base paper sheet free from a magnesium compound was subjected to the same test as in Example 1. The test results are shown in Table 2.

TABLE 2

| Example No. | Item | Pigment layer: Type of pigment | Pigment layer: Amount of pigment (g/m$^2$) | Pigment layer: Pigment layer coated surface | Energy level of electron beam (Mrad) | Fog density |
|---|---|---|---|---|---|---|
| Example | 3 | $Mg(OH)_2$ | 4 | Front surface | 3 | 0.10 |
| | 4 | $Mg(OH)_2$ | 16 | Front surface | 3 | 0.08 |
| | 5 | $Mg(OH)_2$ | 16 | Front surface | 3 | 0.12 |
| | 6 | $Mg(OH)_2$ | 4 (front)<br>4 (back) | Front and back surfaces | 3 | 0.07 |
| Comparative Example | 2 | — | — | — | 3 | 1.27 |
| | 3 | $Mg(OH)_2$ | 0.4 | Front surface | 3 | 0.76 |
| | 4 | — | 0 $(*)_6$ | Front surface | 3 | 1.21 |
| | 5 | Precipitated $CaCO_3$ | 4 | Back surface | 3 | 0.95 |
| Referential Example | 2 | RC paper sheet | | | | 0.12 |

Note:
$(*)_6$ . . . The coated layer had a weight of 5 g/m$^2$ but did not contain a pigment.

Example 7

A paper sheet made from a cellulosic pulp and having a basis weight of 175 g/m$^2$ was employed as a substrate sheet.

A back surface of the substrate sheet was coated with a polyethylene resin by a customary melt extrusion-coating method to form a back coating layer having a weight of 30 g/m$^2$.

A coating composition was prepared in the following composition.

| Component | Part by weight |
|---|---|
| Epoxy acrylate oligomer (Viscoat 540) | 42.0 |
| Di-functional acrylate monomer (HDDA) | 18.0 |
| Titanium dioxide (A220) | 32.0 |
| Magnesium oxide $(*)_7$ | 8.0 |

Note:
$(*)_7$ . . . Available under the trademark of UCM150, from Ube Industries, Ltd.

The composition was mixed and dispersed by a paint conditioner for one hour.

A front surface of the substrate sheet was coated with the coating composition by using a wire bar. The resultant coating composition layer was cured by irradiating an electron beam under an accelerating voltage of 165 kV at an energy level of 2 Mrad, to provide a cured front coating layer having a dry solid weight of 20 g/m$^2$.

The magnesium oxide was contained in this front coating layer in a weight of 1.6 g/m$^2$.

The front coating layer formed a front surface of the resultant support sheet.

A specimen of the resultant support sheet was subjected to the same fogging tests as mentioned in Example 1.

The test results are shown in Table 3.

Example 8

The same procedures as in Example 7 were carried out except that the coating composition for the front coating layer had the following composition.

| Component | Part by weight |
|---|---|
| Epoxy acrylate oligomer (Viscoat 540) | 42.0 |
| Di-functional acrylate monomer (HDDA) | 18.0 |
| Titanium dioxide (A220) | 20.0 |
| Magnesium oxide (UCM150) | 20.0 |

In the resultant front coating layer, the weight of magnesium oxide was 4 g/m$^2$.

The test results are shown in Table 3.

Example 9

The same procedures as in Example 7 were carried out except that the coating composition for the front coating layer had the following composition.

| Component | Part by weight |
|---|---|
| Epoxy acrylate oligomer (Viscoat 540) | 42.0 |
| Di-functional acrylate monomer (HDDA) | 18.0 |
| Titanium dioxide (A220) | 8.0 |
| Magnesium oxide (UCM150) | 32.0 |

In the resultant front coating layer, the amount of magnesium oxide was 6.4 g/m$^2$.

The test results are shown in Table 3.

Example 10

The same procedures as in Example 8 were carried out except that magnesium oxide was replaced by magnesium hydroxide.

The test results are shown in Table 3.

Example 11

The same procedures as in Example 7 were carried out except that, in the superimposing of the support sheet specimen on the photographic printing sheet specimen, the back coating layer surface of the support sheet specimen was brought into contact with the photographic emulsion layer surface of the photographic printing sheet specimen.

After the support sheet specimen was separated from the photographic printing sheet specimen, the support sheet specimen was subjected to the same fogging test as in Example 1.

The test results are shown in Table 3.

Comparative Example 6

The same procedures as in Example 7 were carried out except that the coating composition for the front coating layer had the following composition.

| Component | Part by weight |
|---|---|
| Epoxy acrylate oligomer (Viscoat 540) | 42.0 |
| Di-functional acrylate monomer (HDDA) | 18.0 |
| Titanium dioxide (A220) | 40.0 |

The resultant front coating liquid contained no magnesium compound.

The test results are shown in Table 3.

Comparative Example 7

The same procedures as in Example 7 were carried out except that the coating composition for the front coating layer had the following composition.

| Component | Part by weight |
|---|---|
| Epoxy acrylate oligomer (Viscoat 540) | 42.0 |
| Di-functional acrylate monomer (HDDA) | 18.0 |
| Titanium dioxide (A220) | 38.0 |
| Magnesium oxide (UCM150) | 2.0 |

The resultant front coating layer contained 0.4 g/m$^2$ of magnesium oxide.

The test results are shown in Table 3.

Comparative Example 8

The same procedures as in Example 8 were carried out except that magnesium oxide was replaced by precipitated calcium carbonate (Brilliant-150).

The resultant front coating layer contained 4 g/m$^2$ of calcium carbonate.

The test results are shown in Table 3.

TABLE 3

| | | Front coating layer | | | | |
|---|---|---|---|---|---|---|
| Example No. | Item | Type of pigment | Amount of magnesium compound (g/m$^2$) | Fogging-tested surface | Absorbed electron beam dose (Mrad) | Fogging intensity |
| Example | 7 | $TiO_2$:MgO (80:20) | 1.6 | Front surface | 2 | 0.13 |
| | 8 | $TiO_2$:MgO (50:50) | 4.0 | Front surface | 2 | 0.08 |
| | 9 | ($TiO_2$:MgO) (20:80) | 6.4 | Front surface | 2 | 0.07 |
| | 10 | ($TiO_2$:$Mg(OH)_2$) (50:50) | 4.0 | Front surface | 2 | 0.08 |
| | 11 | $TiO_2$:MgO (80:20) | 1.6 | Back surface | 2 | 0.15 |
| Comparative Example | 6 | $TiO_2$ (100) | — | Front surface | 2 | 1.52 |
| | 7 | $TiO_2$ (95:5) | 0.4 | Front surface | 2 | 0.57 |
| | 8 | $TiO_2$:$CaCO_3$ (50:50) | 0 | Front surface | 2 | 1.36 |

in all of Examples 1 to 11, it was confirmed that no fogging and yellowing of the resultant photographic printing sheets occured even after storage for 12 months.

We claim:

1. A support sheet for a photographic printing sheet comprising:

a substrate sheet comprising (1) a base paper layer comprising a cellulosic pulp material and (2) one pigment layer or two pigment layers located on a front surface alone (hereinafter referred to as front pigment layer) or both front and back surfaces (hereinafter referred to as back pigment layer) of the base paper layer;

a front coating layer located on a front side of the substrate sheet, said front coating layer comprising a mixture of an electron beam irradiation-curing product of at least one electron beam-curable unsaturated organic compound and a white pigment; and a back coating layer located on a back side of the substrate sheet, said back coating layer comprising a film-forming synthetic resinous material, said front pigment layer alone or both said front and back pigment layers of the substrate sheet containing a binder and 1 to 50 g/cm$^2$ of an anti-fogging agent selected from the group consisting of magnesium hydroxide, magnesium carbonate, magnesium oxide, and magnesium sulfate.

2. The support sheet as claimed in claim 1, wherein the base paper sheet of the substrate layer has a basis weight of 50 to 300 g/m$^2$.

3. The support sheet as claimed in claim 1, wherein the electron beam-curable organic unsaturated compound is selected from the group consisting of:

(1) acrylate compounds of mono- to hexa-hydric aliphatic, cycloaliphatic and aromatic alcohols and polyalkyleneglycols;

(2) acrylate compounds of addition reaction products of mono- to hexa-hydric aliphatic, cycloaliphatic and aromatic alcohols with alkylene-oxides;

(3) polyacryloylalkylphosphoric acid esters;

(4) reaction products of carboxylic acids with polyols and acrylic acid;

(5) reaction products of isocyanates with polyols and acrylic acid;

(6) reaction products of epoxy compounds with acrylic acid; and (7) reaction products of epoxy compounds with polyols and acrylic acid.

4. The support sheet as claimed in claim 1, wherein the front coating layer has a weight of 2 to 60 g/m$^2$.

5. The support as claimed in claim 1, wherein the film-forming synthetic resinous material in the back coating layer comprises at least one member selected from polyolefin resins, and cured resinous materials produced from at least one electron beam-curable organic unsaturated compound by irradiating an electron beam thereto.

6. The support sheet as claimed in claim 1, wherein the back coating layer has a weight of 10 to 40 g/m$^2$.

* * * * *